US007541934B2

(12) United States Patent
Fredriksson et al.

(10) Patent No.: US 7,541,934 B2
(45) Date of Patent: Jun. 2, 2009

(54) METHOD AND DEVICE FOR FALL PREVENTION AND DETECTION

(75) Inventors: Anders Fredriksson, Malmö (SE); Fredrik Rosqvist, Malmö (SE)

(73) Assignee: Secumanagement B.V., Leidschendam (NL)

( * ) Notice: Subject to any disclaimer, the term of this patent is extended or adjusted under 35 U.S.C. 154(b) by 526 days.

(21) Appl. No.: 10/536,016

(22) PCT Filed: Nov. 21, 2003

(86) PCT No.: PCT/SE03/01814

§ 371 (c)(1),
(2), (4) Date: May 23, 2005

(87) PCT Pub. No.: WO2004/047039

PCT Pub. Date: Jun. 3, 2004

(65) Prior Publication Data

US 2006/0145874 A1 Jul. 6, 2006

(30) Foreign Application Priority Data

Nov. 21, 2002 (SE) ..... 0203483

(51) Int. Cl.
*G08B 23/00* (2006.01)

(52) U.S. Cl. ..... 340/573.1; 340/686.1; 340/573.4; 340/573.7

(58) Field of Classification Search ..... 340/686.1, 340/686.6, 517, 573.4, 573.1, 573.7, 555, 340/556, 557, 552, 567, 575; 348/148, 154, 348/155, 169; 600/473, 534
See application file for complete search history.

(56) References Cited

U.S. PATENT DOCUMENTS

| | | | | |
|---|---|---|---|---|
| 5,099,324 | A | 3/1992 | Abe | |
| 6,049,281 | A | 4/2000 | Osterweil | |
| 6,211,787 | B1 * | 4/2001 | Yoshiike et al. | 340/573.1 |
| 6,462,663 | B1 | 10/2002 | Wilson et al. | |

(Continued)

FOREIGN PATENT DOCUMENTS

| | | | |
|---|---|---|---|
| EP | 1 117 081 | A3 | 7/2001 |
| EP | 1 195 139 | A1 | 4/2002 |
| EP | 0 933 726 | A3 | 2/2003 |
| SE | 523 547 | C2 | 4/2004 |
| WO | WO-01/48696 | A1 | 7/2001 |
| WO | WO-01/48719 | A1 | 7/2001 |

(Continued)

*Primary Examiner*—Anh V La
(74) *Attorney, Agent, or Firm*—Birch, Stewart, Kolasch & Birch, LLP

(57) ABSTRACT

Method and device for fall prevention and detection, specially for the elderly care based on digital image analysis using an intelligent optical sensor. The fall detection is divided into two main steps; finding the person on the floor, and examining the way in which the person ended up on the floor. The first step is further divided into algorithms investigating the percentage share of the body on the floor, the inclination of the body and the apparent length of the person. The second step includes algorithms examining the velocity and acceleration of the person. When the first step indicates that the person is on the floor, data for a time period of a few seconds before and after the indication is analysed in the second step. If this indicates fall, a countdown state is initiated in order to reduce the risk of false alarms, before sending an alarm. The fall prevention is also divided into two main steps; identifying a person entering a bed, and identifying the person leaving the bed to end up standing beside it. The second step is again further divided into algorithms investigating the surface area of on or more objects in an image, the inclination and the apparent length of these objects. When the second step indicates that a person is in an upright condition, a countdown state is initiated in order to allow for the person to return to the bed.

38 Claims, 7 Drawing Sheets

U.S. PATENT DOCUMENTS

| | | | | |
|---|---|---|---|---|
| 6,544,200 | B1 * | 4/2003 | Smith et al. | 600/595 |
| 6,897,781 | B2 * | 5/2005 | Cooper et al. | 340/573.1 |
| 2001/0004234 | A1 | 6/2001 | Petelenz et al. | |
| 2005/0219059 | A1 * | 10/2005 | Ulrich et al. | 340/686.1 |

FOREIGN PATENT DOCUMENTS

| | | | |
|---|---|---|---|
| WO | WO-01/49033 | A1 | 7/2001 |
| WO | WO-01/56471 | A1 | 8/2001 |
| WO | WO-03/027977 | A1 | 4/2003 |

* cited by examiner

METHOD AND DEVICE FOR FALL PREVENTION AND DETECTION

FIELD OF TECHNOLOGY

The present invention relates to a method and a device for fall prevention and detection, specially for monitoring elderly people in order to emit an alarm signal in case of a risk for a fall or an actual fall being detected.

BACKGROUND ART

The problem of accidental falls among elderly people is a major health problem. More than 30 percent of people more than 80 years old fall at least once during a year and as many as 3,000 aged people die from fall injuries in Sweden each year. Preventive methods can be used but falls will still occur and with increased average lifetime, the share of population above 65 years old will be higher, thus resulting in more people suffering from falls.

Different fall detectors are available. One previously known detector comprises an alarm button worn around the wrist. Another detector, for example known from US 2001/0004234, measures acceleration and body direction and is attached to a belt of the person. But people refusing or forgetting to wear this kind of detectors, or being unable to press the alarm button due to unconsciousness or dementia, still need a way to get help if they are incapable of getting up after a fall.

Thus, there is a need for a fall detector that remedies the above-mentioned shortcomings of prior devices.

In certain instances, it might also be of interest to provide for fall prevention, i.e. a capability to detect an increased risk for a future fall condition, and issue a corresponding alarm.

Intelligent optical sensors are previously known, for example in the fields of monitoring and surveillance, and automatic door control, see for example WO 01/48719 and SE 0103226-7. Thus, such sensors may have an ability to determine a person's location and movement with respect to predetermined zones, but they currently lack the functionality of fall prevention and detection.

SUMMARY OF THE INVENTION

An object of the present invention therefore is to solve the above problems and thus provide algorithms for fall prevention and detection based on image analysis using image sequences from an intelligent optical sensor. Preferably, such algorithms should have a high degree of precision, to minimize both the number of false alarms and the number of missed alarm conditions.

This and other objects that will be apparent from the following description have now been achieved, completely or at least partially, by means of methods and devices according to the independent claims. Preferred embodiments are defined in the dependent claims.

The fall detection of the present invention may be divided into two main steps; finding the person on the floor and examining the way in which the person ended up on the floor. The first step may be further divided into algorithms investigating the percentage share of the body on the floor, the inclination of the body and the apparent length of the person. The second step may include algorithms examining the velocity and acceleration of the person. When the first step indicates that the person is on the floor, data for a time period before, and possibly also after, the indication may be analysed in the second step. If this analysis indicates a fall, a countdown state may be initiated in order to reduce the risk of false alarms, before sending an alarm.

The fall prevention of the present invention may also be divided into two main steps; identifying a person entering a bed, and identifying the person leaving the bed to end up standing beside it. The second step may be further divided into algorithms investigating the surface area of one or more objects in an image, the inclination of these objects, and the apparent length of these objects. When the second step indicates that a person is in an upright condition, a countdown state may be initiated in order to allow for the person to return to the bed.

SHORT DESCRIPTION OF THE DRAWINGS

Further objects, features and advantages of the invention will appear from the following detailed description of the invention with reference to the accompanying drawings, in which.

DETAILED DESCRIPTION OF EMBODIMENTS OF THE INVENTION

Figure 1:
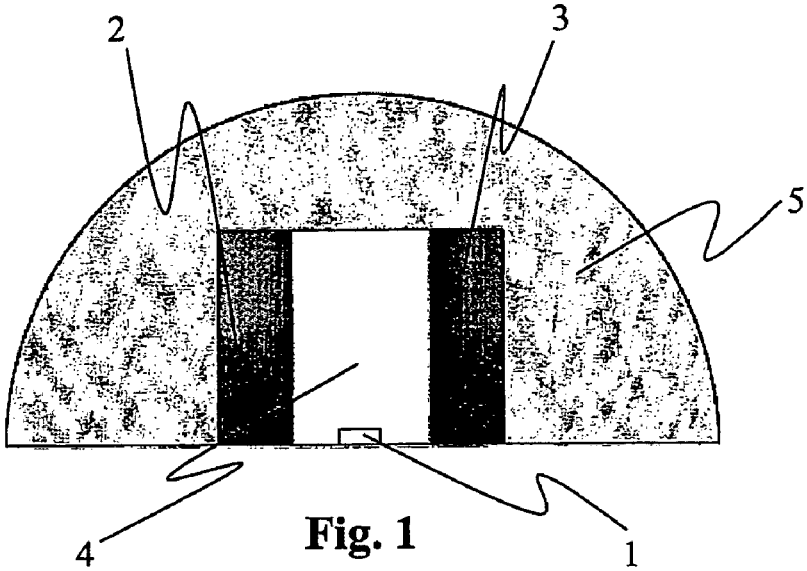
FIG. 1 is a plan view of a bed and surrounding areas, where the invention may be performed.

Sweden has one of the worlds highest shares of population older than 65 years. This share will increase further. The situation is similar in other Western countries. An older population puts larger demands on the medical care. One way to fulfil these high demands may be to provide good technical aids.

In the field of geriatrics, confusion, incontinence, immobilization and accidental falls are sometimes referred to as the "geriatric giants". This denomination is used because these problems are both large health problems for elderly, and symptoms of serious underlying problems. The primary reasons for accidental falls can be of various kinds, though most of them have dizziness as a symptom. Other causes are heart failures, neurological diseases and poor vision.

As much as half of the older persons who contact the emergency care in Sweden do this for dizziness and fall-related problems. This makes the problem a serious health issue for the elderly.

Risk factors for falls are often divided into external and intrinsic risk factors. It is about the same risk that a fall is caused by an external risk factor as it is by an intrinsic risk factor. Sometimes the fall is a combination of both.

External risk factors include high thresholds, bad lighting, slippery floors and other circumstances in the home environment. Another common external risk is medicines, itself or in combination, causing e.g. dizziness for the aged. Another possible and not unusual external effect is inaccurate walking aids.

Intrinsic risk factors depend on the patient himself. Poor eyesight, reduced hearing or other factors making it harder for elderly to observe obstacles are some examples. Others are dementia, degeneration of the nervous system and muscles making it harder for the person to parry a fall and osteoporosis, which makes the skeleton more fragile.

In order to avoid elderly from falling, different preventive measures could be taken, e.g. removing thresholds and carpets and mounting handrails on the beds. In short, minimizing the external risk factors. This may also be combined with frequent physical exercise for the elderly. But whatever measures that is taken, falls will still occur, causing pain and anxiousness among the elderly.

When an elderly person falls, it often results in minor injuries such as bruises or small wounds. Other common consequences are soft-tissue injuries and fractures, including hip fractures. The elderly could also sustain pressure-wounds if he or she lies on the floor for a longer time without getting help.

In addition to physical effects, a fall has also psychological effects. Many elderly are afraid of falling again and choose to move to elderly care centres or to not walk around as they used to do. This makes them more immovable, which weaken the muscles and frails the skeleton. They enter a vicious circle.

It is important to make the elderly person who suffered from a fall accident to feel more secure. If he or she falls, a nurse should be notified and assist the person. Today a couple of methods are available. The most common is an alarm button worn around the wrist. In this way the person can easily call for help when needed. Another solution is a fall detector mounted e.g. on the person's belt, measuring high accelerations or changes in the direction of the body.

The present invention provides a visual sensor device that has the advantage that it is easy to install and is cheap and possible to modify for the person's own needs. Furthermore, it doesn't demand much effort from the person using it. It also provides for fall prevention or fall detection, or both.

The device may be used by and for elderly people who want an independent life without the fear of not getting help after a fall. It can be used in home environments as well as in elderly care centres and hospitals.

The device according to the invention comprises an intelligent optical sensor, as described in Applicant's PCT publications WO 01/48719, WO 01/49033 and WO 01/48696, the contents of which are incorporated in the present specification by reference.

The sensor is built on smart camera technology, which refers to a digital camera integrated with a small computer unit. The computer unit processes the images taken by the camera using different algorithms in order to arrive at a certain decision, in our case whether there is a risk for a future fall or not, or whether a fall has occurred or not.

The processor of the sensor is a 72 MHz ASIC, developed by C Technologies AB, Sweden and marketed under the trademark Argus CT-100. It handles both the image grabbing from the sensor chip and the image processing. Since these two processes share the same computing resource, considerations has to be taken between higher frame rate on the one hand, and more computational time on the other. The system has 8 MB SDRAM and 2 MB NOR Flash memory.

The camera covers 116 degrees in the horizontal direction and 85 degrees in the vertical direction. It has a focal length of 2.5 mm, and each image element (pixel) measures 30×30 $\mu m^2$. The camera operates in the visual and near infrared wavelength range.

The images are 166 pixels wide and 126 pixels high with an 8 bit grey scale pixel value. The sensor may be placed above a bed 1 overlooking the floor. As shown in FIG. 1, the floor area monitored by the sensor 1 may be divided into zones; two presence-detection zones 2, 3 along the long sides of the bed 4 and a fall zone 5 within a radius of about three meters from the sensor 1. The presence-detection zones 2, 3 may be used for detecting persons going in and out of the bed, and the fall zone 5 is the zone in which fall detection takes place. It is also conceivable to define one or more presence-detection zones within the area of the bed 4, for example to detect persons entering or leaving the bed. The ranges of the zones can be changed with a remote control, as described in Applicant's PCT publication WO 03/027977, the contents of which is incorporated in the present specification by reference. It should be noted that the presence-detection zones could have any desired extent, or be omitted all together.

The fall detection according to the present invention is only one part of the complete system. Another feature is a bed presence algorithm, which checks if a person is going in or out of the bed. The fall detection may be activated only when the person has left the bed.

The system may be configured not to trigger the alarm if more than one person is in the room, since the other person not falling is considered capable of calling for help. Pressing a button attached to the sensor may deactivate the alarm. The alarm may be activated again automatically after a preset time period, such as 2 hours, or less, so that the alarm is not accidentally left deactivated.

The sensor may be placed above the short side of the bed at a height of about two meters looking downwards with an angle of about 35 degrees. This placement is a good position since no one can stand in front of the bed, thereby blocking the sensor and it is easy to get a hint of whether the person is standing, sitting or lying down. However, placing the sensor higher up, e.g. in the corner of the room would decrease the number of hidden spots and make it easier with shadow reduction on the walls, since the walls can be masked out. Of course, other arrangement are possible, e.g. overlooking one longitudinal side of the bed. The arrangement and installation of the sensor may be automated according to the method described in Applicant's PCT publication WO 03/091961, the contents of which is incorporated in the present specification by reference.

The floor area monitored by the sensor may coincide with the actual floor area or be smaller or larger. If the monitored floor area is larger than the actual floor area, some algorithms to be described below may work better. The monitored floor area may be defined by the above-mentioned remote control.

In order to make a system that could recognize a fall, the distinguishing features for a fall have to be found and analysed. The distinguishing features for a fall can be divided into three events:

1) The body moves towards the floor with a high velocity in an accelerating movement.

2) The body hits the floor and a retarding movement occurs.

3) The person lies fairly still on the floor, with no motion above a certain height, about one meter.

One can of course find other distinguishing features for a fall. However, many of them are not detectable by an optical sensor. A human being could detect a possible fall by hearing the slam that occurs when the body hits the floor. Of course, such features could be accounted for by connecting or integrating a microphone with the above sensor device.

There are different causes for a fall, and also different types of fall. Those connected to high velocities and much (heavy) motion are easy to detect while others happen more slowly or with smaller movement. It is therefore important to characterize a number of fall types.

Bed Fall

A person falls from the bed down onto the floor. Since the fall detection should not be used until the system has detected an "out of bed"-event, this fall is a special case. One way to solve this is to check if the person is lying on the floor for a certain time after he or she left the bed.

Collapse Fall

A person suffering from a sudden lowering in blood pressure or having a heart attack could collapse on the floor. Since the collapse can be of various kinds, fast or slow ones, with more or less motion, it could be difficult to detect those falls.

Chair Fall

A person falling off a chair could be difficult to detect, since the person is already close to the floor and therefore will not reach a high velocity.

Reaching And Missing Fall

Another type of falls is when a person reaches for example a chair, misses it and falls. This could be difficult to detect if the fall occurs slowly, but more often high velocities are connected to this type of fall.

Slip Fall

Wet floors, carpets etc. could make a person slip and fall. High velocities and accelerations are connected to this type of fall making it easy to separate from a non-fall situation, e.g. a person lying down on the floor.

Trip Fall

This type of fall has the same characteristics as the slip fall, making it easy to detect. Thresholds, carpets and other obstacles are common causes for trip falls.

Upper Level Fall

Upper level falls include falls from chairs, ladders, stairs and other upper levels. The high velocities and accelerations are present here.

The detection must be accurate. The elderly have to receive help when they fall but the system may not send too many false alarms, since it would cost a lot of money and decrease the trust of the product. Thus, it must be a good balance between false alarms and missed detections.

By finding the fact that a person is lying on the floor by a "floor algorithm" may be sufficient for sending an alarm. Here it is important to wait for a couple of minutes before alarming to avoid false alarms.

Another approach is to detect that a person is lying on the floor for a couple of seconds by the floor algorithm and then detect whether a fall had occurred by a "fall algorithm". In this way the fall detection algorithm must not run all the time but rather at specific occasions.

Yet another approach is to detect that a person attains an upright position, by an "upright position algorithm", and then sending a preventive alarm. The upright position may include the person sitting on the bed or standing beside it. Optionally, the upright position algorithm is only initiated upon the detection, by a bed presence algorithm, of a person leaving the bed. Such an algorithm may be used whenever the monitored person is known to have a high disposition to falling, e.g. due to poor eyesight, dizziness, heavy medication, disablement and other physical incapabilities, etc.

Both the floor algorithm and the upright position algorithm may use the length of the person and the direction of the body as well as the covering of the floor by the person.

The fall algorithm may detect heavy motion and short times between high positive and high negative accelerations.

A number of borderline cases for fall detection may occur. A person lying down quickly on the floor may fulfil all demands and thereby trigger the alarm. Likewise, if the floor area is large, a person sitting down in a sofa may also trigger the alarm. A coat falling down on the floor from a clothes hanger may also trigger the alarm.

There are also borderline cases that work in the opposite direction. A person having a heart attack may slowly sink down on the floor.

In order to obtain statistical data used for the following evaluation, several tests films have been performed with the following conditions.

The frame rate in the tests films is about 3 Hz under normal light conditions compared to about 10-15 Hz when the images are handled inside the sensor. All tests films were shot under good light conditions.

In order to see that the system worked properly not only in the test studio, the tests films were performed in six different home interiors. Important differences between the interiors were different illumination conditions, varying sunlight, varying room size, varying number of walls next to the bed, diverse objects on the floor, etc.

Figure 2:
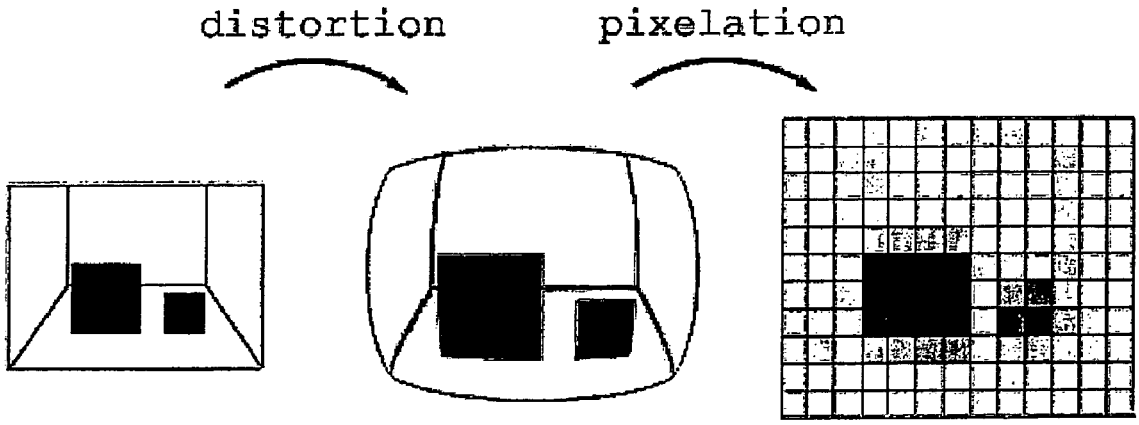
FIG. 2 is a diagram showing the transformation from undistorted image coordinates to pixel coordinates.

When the camera takes a picture, it may transform the room coordinates to image coordinates, pixels. This procedure may be divided into four parts: room to sensor, sensor to undistorted image coordinates, undistorted to distorted image coordinates, and distorted image coordinates to pixel coordinates, see FIG. 2 for the last two steps.

Figure 3:
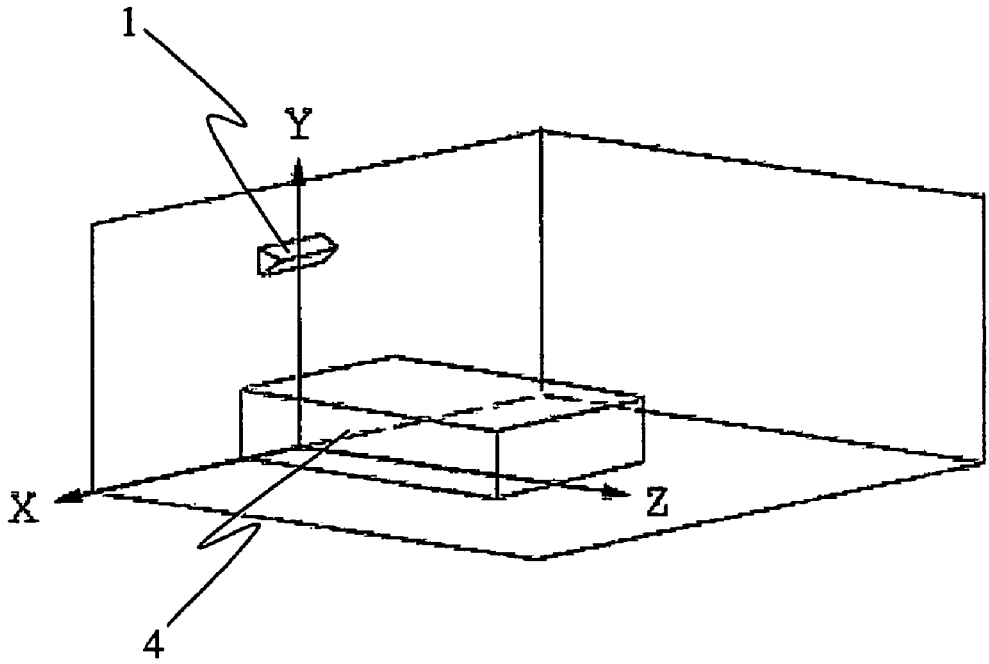
FIG. 3 is diagram of a room coordinate system.

The room coordinate system has its origin on the floor right below the sensor 1, with the X axis along the sensor wall, the Y axis upwards and the Z axis out in the room parallel to the left and right wall, as shown in FIG. 3.

Figure 4:
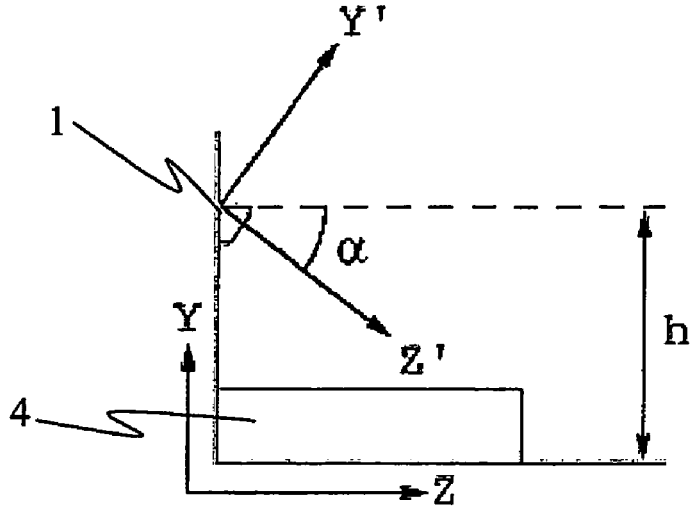
FIG. 4 is a diagram of the direction of sensor coordinates in the room coordinate system of FIG. 3.

In FIG. 4, the sensor axes are denoted X', Y' and Z'. The sensor coordinate system has the same X-axis as the room coordinate system. The Y' axis extends upwardly as seen from the sensor, and the Z' axis extends straight out from the sensor, i.e. with an angle $\alpha$ relative to the horizontal (Z axis).

The transformation from room coordinates to sensor coordinates is a translation in Y followed by a rotation around the X axis, $$X'=X$$

$$Y'=(Y-h)\cdot\cos(\alpha)+Z\cdot\sin(\alpha)$$

$$Z'=-(Y-h)\cdot\sin(\alpha)+Z\cdot\cos(\alpha) \quad [1]$$

where h is the height of the sensor and α is the angle between the Z and Z' axis.

While the room has three axes, the image has only two. Thus, the sensor coordinates has to be transformed to two-dimensional image coordinates. The first step is perspective divide, which transforms the sensor coordinates to real image coordinates.

If the camera behaves as a pinhole camera:

$$\frac{x_u}{f} = \frac{X'}{Z'} \quad [2]$$

where f is the focal length of the lens. Accordingly, the undistorted image coordinates $x_u$ and $y_u$ are given by:

$$x_u = f \cdot \frac{X'}{Z'} \text{ and respectively for } y_u = f \cdot \frac{Y'}{Z'} \quad [3]$$

Notice that when transforming back from image coordinates to room coordinates the system is underdetermined. Thus, one of the room coordinates should be given a value before transforming.

The sensor uses a fish-eye lens that distorts the image coordinates. The distortion model used in our embodiments is:

$$(x_d, y_d) = (x_u, y_u) \cdot \frac{\tan^{-1}\left(2r_u \cdot \tan\left(\frac{w}{2}\right)\right)}{w \cdot r_u}, \text{ where} \quad [4]$$

$$r_u = \sqrt{x_u^2 + y_u^2}$$

The image is discretely divided into m rows and n columns with origin (1,1) in the upper left corner. To obtain this, a simple transformation of the distorted coordinates ($x_d$, $y_d$) is done:

$$x_i = \frac{x_d}{x_p} + \frac{n}{2} \quad [5]$$

$$y_i = \frac{m}{2} - \frac{y_d}{y_p}$$

where $x_p$ and $y_p$ is the width and height, respectively, of a pixel, and $x_i$ and $y_i$ are the pixel coordinates.

The goal of the pre-treatment of the images is to create a model of the moving object in the images. The model has the knowledge of which pixels in the image that belongs to the object. These pixels are called foreground pixels and the image of the foreground pixels are called the foreground image.

How can you tell whether a certain object is part of the background or is moving in relation to the background? By just looking at one single image it may be difficult to decide, but with more than one image in a series of images it is more easily achievable. What then differs the background from the foreground? In this case, it is the movement of the objects. An object having different locations in space in a series of images is considered moving and an object having the same appearance for a certain period of time is considered as a background. This means that a foreground object will become a background object whenever it stops to move, and will once again become a foreground object when it starts moving again. The following algorithm calculates the background image.

Background Algorithm

The objective is to create an image of the background that does not contain moving objects according to what has been mentioned above. Assume a series of N grey scale images $I_0 \ldots I_N$, consisting of m rows and n columns. Divide the images in blocks of 6×6 pixels and assign a timer to each block controlling when to update the block as background. Now, for each image $I_i$, i=x . . . N, subtract $I_i$ with the image $I_{i-x}$ to obtain a difference image $DI_i$. For each block in $DI_i$, reset the timer if there are more than y pixels with an absolute pixel value greater than z. Also reset the timers for the four nearest neighbours. If there are less than y pixels, the block is considered as motionless and the corresponding block in $I_i$ is updated as background if its timer has ended. The parameter values used are x=10, y=5, and timer ending=2000 ms. The noise determines the value of z.

To determine the value of z, it is convenient to estimate the noise in the image. The model described below is quite simple but gives good results.

Assume a series of N images $I_i \ldots I_{i+N-1}$. The standard deviation of the noise for the pixel at row u and column v is then:

$$\sigma_{u,v} = \sqrt{\frac{1}{N} \sum_{j=i}^{i+N-1} (p(u, v, j) - m(u, v))^2} \quad [6]$$

where p(u,v,j) is the pixel value at row u and column v in image j, and $$m(u, v) = \frac{1}{N} \sum_{k=i}^{i+N-1} p(u, v, k) \quad [7]$$

is the mean of the pixels at row u and column v in the N images. The mean standard deviation of all pixels is then:

$$\overline{\sigma_{noise}} = \frac{1}{m \cdot n} \sum_{u=1}^{m} \sum_{v=1}^{n} \sigma_{u,v} \quad [8]$$

The estimation of the noise has to be done all the time since changes in light, e.g. opening a Venetian blind, will increase or decrease the noise. The estimation cannot be done on the entire image since a presence of a moving object will increase the noise significantly. Instead, this is done on just the four corners, in blocks of 40×40 pixels with the assumption that a moving object will not pass all four corners during the time elapsed from image $I_i$ until image $I_{i+N-1}$. The value used is the minimum of the four mean standard deviations. In the present embodiments, z is chosen as $$z = 3 \cdot \overline{\sigma_{noise}} \quad [9]$$

Foreground

By subtracting the background image from the present image a difference image is obtained. This image now contains those areas in which motion has occurred. In an ideal image, it now suffices to select as foreground pixels those pixels that have an grey scale value above a certain threshold. However, shadows, noise, flickering screens and other disturbances also occur as motion in the image. Persons with clothes having the same colour as the background will also cause a problem, since they may not appear in the difference image.

Shadows

Objects moving in the scene cast shadows on the walls, on the floor and on other objects. Shadows vary in intensity depending on the light source, e.g. a shadow cast by a moving object on a white wall from a spotlight might have higher intensity than the object itself in the difference image. Thus, shadow reduction may be an important part of the pre-treatment of the images.

To reduce the shadows, the pixels in the difference images with high grey scale values are kept as foreground pixels as well as areas with high variance. The variance is calculated as a point detection using a convolution, see Appendix A, between the difference image and a 3×3-matrix SE:

$$SE = \begin{bmatrix} 1 & 1 & 1 \\ 1 & -8 & 1 \\ 1 & 1 & 1 \end{bmatrix} \quad [10]$$

Noise And False Objects

The image is now a binary image consisting of pixels with values 1 for foreground pixels. It may be important to remove small noise areas and fill holes in the binary image to get more distinctive segments. This is done by a kind of morphing, see Appendix A, where all 1-pixels with less than three 1-pixel neighbours are removed, and all 0-pixels with more than three 1-pixel neighbours are set to 1.

If the moving person picks up another object and puts it away on some other place in the room, then two new "objects" will arise. Firstly, at the spot where object was standing, the now visible background will act as an object and secondly, the object itself will act as a new object when placed at the new spot since it will then hide the background.

Such false objects can be removed, e.g. if they are small enough compared to the moving person, in our case less than 10 pixels, or by identifying the area(s) where image movement occurs and by elimination objects distant from such area(s). This is done in the tracking algorithm.

Tracking Algorithm

Keeping track of the moving person can be useful. False objects can be removed and assumptions on where the person will be in the next frame can be made.

The tracking algorithm tracks several moving objects in a scene. For each tracked object, it calculates an area A in which the object is likely to appear in the next image:

The algorithm maintains knowledge of where each tracked object has been for the last five images, in room coordinates $X_0 \ldots X_4$, $Y_0 \ldots Y_4=0$ and $Z_0 \ldots Z_4$. The new room or floor coordinates are calculated as $$X_{new} = X_0 + (X_0 - X_1) \cdot \frac{|X_0 - X_1|}{|X_1 - X_2|} \quad [11]$$

and respectively for $Z_{new}$. $Y_{new}=0$.

The coordinates for a rectangle with corners in ($X_{new}$−0.5, −0.5, $Z_{new}$), ($X_{new}$−0.5, 2.0, $Z_{new}$), ($X_{new}$+0.5, 2.0, $Z_{new}$) and ($X_{new}$+0.5, −0.5, $Z_{new}$) are transformed to pixel coordinates $xi_0 \ldots xi_3$, and the area A is taken as the pixels inside the rectangle with corners at $xi_0 \ldots xi_3$. This area corresponds to a rectangle of 1.0×2.5 meters, which should enclose a whole body.

The tracking is done as follows.

Assuming a binary noise-reduced image I, the N different segments $S_0$ to $S_N$ in I are found using a region-grow segmentation algorithm, see Appendix A.

The different segments are added to a tracked object if they consist of more than 10 pixels and have more than 10 percent of their pixels inside the area A of the object. In this way, several segments could form an object.

The segments that do not belong to an object become new objects themselves if they have more than 100 pixels. This is e.g. how the first object is created.

When all segments have been processed, new X and Z values for the tracked objects are calculated. If a new object is created, new X and Z values are calculated directly to be able to add more segments to that object.

With several objects being tracked, it may become important to identify the object that represents the person. One approach is to choose the largest object as the person. Another approach is to choose the object that moves the most as the person. Yet another approach is to use all objects as input for the fall detection algorithms.

Floor Algorithms

For the floor algorithm, the following algorithms may be used.

On Floor Algorithm

The percentage share of foreground pixels on the floor is calculated by taking the amount of pixels that are both floor pixels and foreground pixels divided by the total amount of foreground pixels.

This algorithm has a small dependence of shadows. When the person is standing up, he or she will cast shadows on the floor and walls but not when lying down. Thus, the algorithm could give false alarms, but has an almost 100 percent accuracy in telling when a person is on the floor. In big rooms, the floor area is large and a bending person or a person sitting in a sofa could fool the algorithm to believe that he or she is on the floor. The next two algorithms help to avoid such false alarms.

Angle Algorithm

One significant difference between a standing person and a person lying on the floor is the angle between the direction of the person's body and the Y-axis of the room. The smaller angle the higher probability that the person is standing up.

The most accurate way of calculating this would be to find the direction of the body in room coordinates. This is, however, not easily achievable, since transforming from 2D image coordinates to 3D room coordinates requires pre-setting one of the room coordinates, e.g. Y=0.

Instead, the Y-axis is transformed, or projected, onto the image in the following way:

1) Transform the coordinates of the person's feet ($u_f$, $v_f$) into room coordinates ($X_f$, $Y_f$=0, $Z_f$).

2) Add a length ΔY to $Y_f$ and transform this coordinate back to image coordinates ($u_h$, $v_h$).

3) The Y-axis is now the vector between ($u_f$, $v_f$) and ($u_h$, $v_h$).

This direction is compared with the direction of the body in the image, which could be calculated in a number of ways. One approach is to use the least-square method. Another approach is to randomly choose N pixels $p_0 \ldots p_{N-1}$, calculate the vectors $v_0 \ldots v_{N/2-1}$, $v_i = p_{2i+1} - p_{2i}$ between the pixels, and finally representing the direction of the body as the mean vector of the vectors $v_0 \ldots v_{N/2-1}$.

Apparent Length Algorithm

A third way is to find the image coordinates for the "head" and the "feet" of the object and calculating the vector between them. Depending on whether the object has a longer height than width, or vice versa, the object is split up vertically or horizontally, respectively, into five parts. The mass centres of the extreme parts are calculated and the vector between them is taken as the direction of the body.

Since measuring of the angle is done in the image, some cases will give false alarms, e.g. if a person is lying on the floor in the direction of the Z-axis straight in front of the sensor. This would look like a very short person standing up and the calculated angle would become very small, indicating that the person is standing up. The next algorithm compensates for this.

Figure 5:
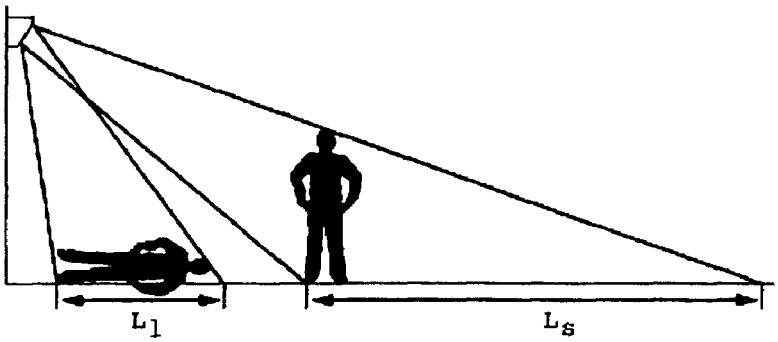
FIG. 5 is a diagram showing the projected length of a person lying on a floor compared to a standing person.

Assume that a person is lying down on the floor in an image. Then it is easy to calculate the length of the body by transforming the "head" and "feet" image coordinates $(u_h, v_h)$ and $(u_f, v_f)$ into room coordinates $(X_h, 0, Z_h)$ and $(X_f, 0, Z_h)$, respectively. The distance between the two room points are then a good measurement of the length of the person. Now, what would happen if the he was standing up? The feet coordinates would be transformed correctly but the head coordinates would be inaccurate. They would be considered much further away from the sensor, see FIG. 5.

Thus, the distance between the two room coordinates would be large and therefore large values of the length of the person, say more than two or three meters would be considered as the person standing up. And consequently small values of the person, less than two or three meters would assume the person to be lying down. The $(u_h, v_h)$ and $(u_f, v_f)$ coordinates may be calculated the same way as in the Angle algorithm.

Fall Algorithms

According to a study on elderly people, the velocity of a fall is 2-3 times higher than the velocity of normal activities such as walking, sitting, bending down, lying down etc. This result is the cornerstone of the following algorithm.

Mass Centre Algorithm

The velocity v of the person is calculated as the distance between the mass centres $M_i$ and $M_{i+1}$ of the foreground pixels of two succeeding images $I_i$ and $I_{i+1}$ divided by the time elapsed between the two images.

$$v = \frac{|M_{i+1} - M_i|}{t_{i+1} - t_i} \quad [12]$$

It may be desirable to calculate the mass centres in room coordinates, but once again this may be difficult to achieve. Instead, the mass centres may be calculated in image coordinates. By doing this, the result becomes dependent on where in the room the person is located. If the person is far away from the sensor, the distances measured will be very short, and the other way around if the person is close to the sensor. To compensate for this, dividing with the Z -coordinate of the person's feet normalizes the calculated distances.

Previous Image Algorithm

Another way to measure the velocity is used in the following algorithm. It is based on the fact that a fast moving object will result in more foreground pixels when using the previous image as the background than a slow one would.

In this algorithm the first step is to calculate a second foreground image $FI_p$ using the previous image as the background. Then this image is compared with the normal foreground image $FI_n$. If an object moves slowly, the previous image would look similar to the present image, resulting in a foreground image $FI_p$ with few foreground pixels. On the other hand, a fast moving object could have as much as twice as many foreground pixels in $FI_p$ as in $FI_n$.

Percentage Share Algorithm

When a person falls, he or she will eventually end up lying on the floor. Thus, no points of the body will be higher than say about half a meter. The idea here is to find a horizontal line in the image corresponding to a height of about one meter. Since this depends on the location of the person within the image, the algorithm starts by calculating the room coordinates for the person's feet. A length $\Delta Y = 1$ m is added to Y, and the room coordinates are transformed back into image coordinates. The image coordinate $y_i$ now marks the horizontal line. The algorithm returns the number of foreground pixels below the horizontal line divided by the total number of foreground pixels.

First Embodiment

The fall detection algorithms MassCentre and PreviousImage show a noisy pattern. They may return many false alarms if they were to be run all the time, since shadows, sudden light changes and false objects fool the algorithms. To reduce the number of false alarms, the Fall algorithms are not run continually, but rather at times when one or more of the Floor algorithms (On Floor, Angle and Apparent Length) indicates that the person is on the floor. Another feature reducing the number of false alarms is to wait a short time before sending an alarm after a fall has occurred. Thus, the fall detection may be postponed until one or more of the Floor algorithms has detected a person on the floor for more than 30 seconds. With this approach the number of false alarms are reduced significantly.

Figure 6:
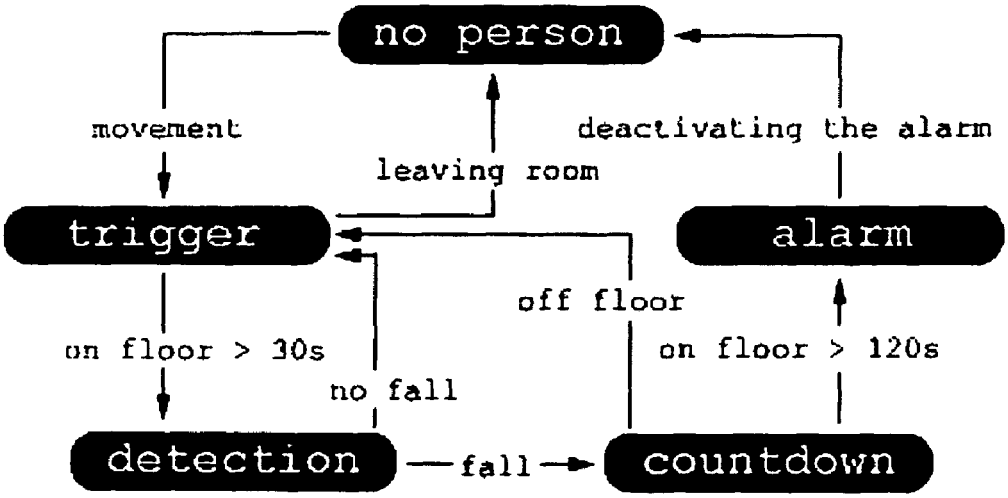
FIG. 6 is a flow chart of a method according to a first embodiment of the invention.

The first embodiment is divided into five states, "No Person state", "Trigger state", "detection state", "Countdown state" and "Alarm state". A state space model of the first embodiment is shown in FIG. 6.

When the sensor is switched on, the embodiment starts in the No Person state. While in this state, the embodiment has only one task, to detect motion. If motion is detected, the embodiment switches to the Trigger state. The embodiment will return to the No Person state if it detects a person leaving the room while in the Trigger state, or if the alarm is deactivated.

Motion detection works by a simple algorithm that subtracts the present image by the previous image and counts those pixels in the resulting image with grey level values above a certain threshold. If the sum of the counted pixels is high enough, then motion has been detected.

Figure 7:
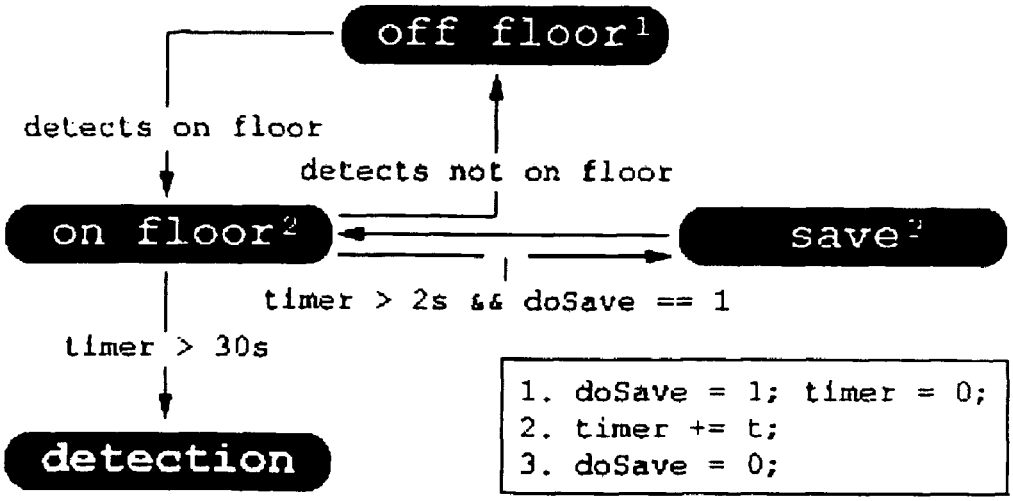
FIG. 7 is a flow chart detailing a process in one of the steps of FIG. 6.

As mentioned above, the Trigger state will be activated as soon as any motion has been detected in the No Person state. The steps of the Trigger state is further illustrated in FIG. 7, in which the algorithm looks for a person lying on the floor, using one or more of the Floor algorithms On Floor, Angle and Apparent Length. In one example, the person is considered to be on the floor if 1) more than 50 percent, and preferably more than about 80 or 90 percent of the body is on the floor, and 2) either the angle of the body is more than at least about 10 degrees, preferably at least 20 degrees, from the vertical, or the length of the person is less than 4 meters, for example below 2 or 3 meters. Here, the On Floor algorithm does the main part of the work, while the combination of the Angle algorithm and the Apparent Length algorithm minimizes the number of false alarms that arises e.g. in large rooms. Other combinations of the Floor algorithms are conceivable, for example forming a combined score value which is based on a resulting score value for each algorithm, and comparing the combined score value to a threshold value for floor detection.

The Trigger state has a timer, which controls the amount of time passed since the person was first detected as on the floor. When the person is off the floor the timer is being reset. When a person has been on the floor for a number of seconds, e.g. 2 seconds, the sequence of data from standing position to lying position is saved for later fall detection, e.g. by the last 5 seconds being saved.

The embodiment switches to the Detection state when a person has been detected as being on the floor for more than 30 seconds.

This state is where the actual fall detection takes place. Based on the saved data from the Trigger state, an analysis is effected of whether a fall has occurred or not. If the detection state detects a fall, the embodiment switches to the Countdown state, otherwise it goes back to the Trigger state.

While in the Countdown state, the embodiment makes sure that the person is still lying on the floor. This is only to reduce the number of false alarms caused by e.g. persons vacuuming under the bed etc. When two minutes has passed and the person is still on the floor, the embodiment switches to the Alarm state. Should the person get off of the floor, embodiment switches back to the Trigger state.

In the Alarm state, an alarm is sent and the embodiment waits for the deactivation of the alarm.

Second Embodiment

As already stated above, it may be desirable to issue an alarm on detection of an upright condition, to thereby prevent a future possible fall. Below, the algorithm(s) used for such detection is referred to as a BedStand process.

Evidently, the above-identified Floor algorithms may also be use to identify an upright condition of an object, for example a person sitting up in the bed or leaving the bed to end up standing beside it. A person could be classified as standing if its apparent length exceeds a predetermined height value, e.g. 2 or 3 meters, and/or if the angle of the person with respect to the vertical room direction is less than a predetermined angle value, e.g. 10 or 20 degrees. The determination of an upright condition could also be conditioned upon the location of the person within the monitored floor area (see FIG. 1), e.g. by the person's feet being within a predetermined zone dedicated to detection of a standing condition. A further condition may be given by the surface area of the object, e.g. to distinguish it from other essentially vertical objects within the monitored floor area, such as curtains, draperies, etc.

It is also to be realized that the above-identified Percentage Share algorithm may be used, either by itself or in combination with any one of the above algorithms, to identify an upright condition, by the share of foreground pixels over a given height, e.g. 1 meter, exceeding a predetermined threshold value.

The combination of algorithms may be done in other ways, for example by forming a combined score value which is based on a resulting score value for each algorithm, and comparing the combined score value to a threshold score value for upright detection.

Fall prevention according to the second embodiment includes a state machine using the above BedStand process and a BedMotion process which checks for movement in the bed and detects a person entering the bed. Before illustrating the state machine, the BedMotion process will be briefly described.

The BedMotion process looks for movement in the bed caused by an object of a certain size, to avoid detection of movement from cats, minor dogs, shadows or lights, etc. The bed is represented as a bed zone in the image. The BedMotion process calculates the difference between the current image and the last image, and also the difference between the current image and an older image. The resulting difference images are then thresholded so that each pixel is either a positive difference, a negative difference or not a difference. The thresholded images are divided into blocks, each with a certain number of pixels. Each block that has enough positive and negative differences, and enough differences in total, are set as detection blocks. The detection blocks are active for some frames ahead. The percentage share of difference pixels in the bed zone compared to the area outside the bed is calculated from the thresholded difference images. The bed zone is then further split up in three parts: lower, middle and upper. A timer is started if there are detections in all three parts. The timer is reset every time one or more parts does not have detections. The requirements for an "in bed detection" is the combination of: the timer has run out; the number of detection blocks in each bed zone part exceeds a limit value; and the percentage share of the difference pixels is high enough. The BedMotion process may also signal that there is movement in the bed based on the total number of detection blocks in the bed zone.

Figure 8:
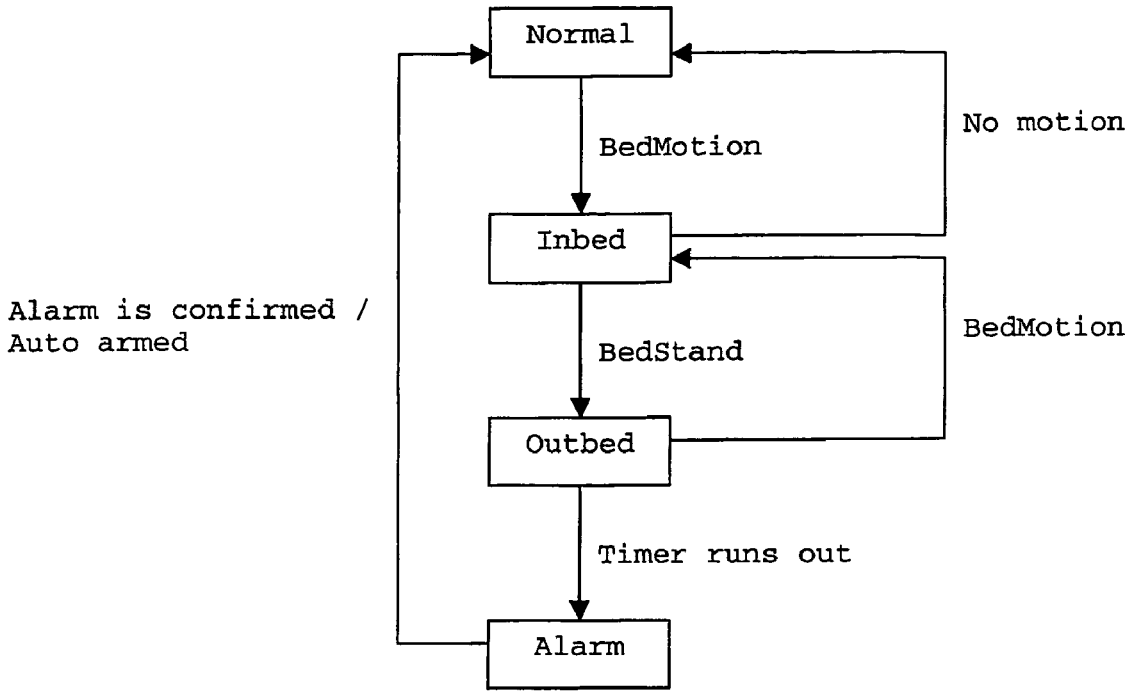
FIG. 8 is a flow chart of a method according to a second embodiment of the invention.

The state machine of the second embodiment is shown in FIG. 8. The sensor starts in a Normal state. When the BedMotion process indicates movement in the bed zone, the embodiment changes state to an Inbed state. The embodiment now looks for upright conditions, by means of the BedStand process. If no upright condition is detected, and if the movement in the bed zone disappears, as indicated by the BedMotion process, the embodiment changes state to the Normal state. If an upright condition is detected, however, the embodiment switches to an Outbed state, thereby starting a timer. If motion is detected by the BedMotion process before the timer has ended, the embodiment returns to the Inbed state. If the timer runs out, the embodiment changes to an Alarm state, and an alarm is issued. The embodiment may return to the Normal state if the alarm is confirmed by an authorized person, e.g. a nurse. The embodiment may also have the ability to automatically arm itself after an alarm.

Statistical Decision Process for Fall Detection

A person can end up on the floor in several ways. However, these can be divided into two main groups: fall or not fall. In order to make the decision process reliable, these two groups of data have to be as separated as possible.

It may also be important to find invariant variables. An invariant variable is a variable that is independent of changes in the environment, e.g. if the person is close or far away from the sensor or if the frame rate is high or low. If it is possible to find many uncorrelated invariant variables, the decision process will be more reliable.

The PreviousImage algorithm may be used to obtain an estimate of the velocity in the picture. As described above, one of the main characteristics of a fall is the retardation (negative acceleration) that occurs when the body hits the floor. An estimate of the acceleration may be obtained by taking the derivative of the results from the PreviousImage algorithm. The minimum value thereof is an estimate of the minimum acceleration or maximum retardation (Variable 1). This value is assumed to be the retardation that occurs when then person hits the floor.

The MassCentre algorithm also measures the velocity of the person. A fall is a big and fast movement, which imply a big return value. Taking the maximum value of the velocity estimate of the MassCentre algorithm (Variable 2), may give a good indication of whether a fall has occurred or not.

Alternatively or additionally, taking the derivative of the velocity estimation of the MassCentre algorithm, may give another estimate of the acceleration. As already concluded above, the minimum acceleration value may give information whether a fall has occurred or not (Variable 3).

Even with well-differentiated data it can be hard to set definite limits. One possible way to calculate the limits is with the help of statistics. In this way the spread of the data, or in a statistical term variance, is taken into account.

The distribution model for the variables is assumed to be the normal distribution. This is an easy distribution to use, and the data received from the algorithms has indicated that this is the distribution to use. The normal probability density function is defined as:

$$f(x) = \frac{1}{(2\pi)^{d/2}|\Sigma|^{1/2}} \cdot e^{\frac{1}{2}(x-m)^T\Sigma^{-1}(x-m)} \quad [13]$$

where d is the dimension of x, m is the expected value and Σ is the covariance matrix.

Figure 9:
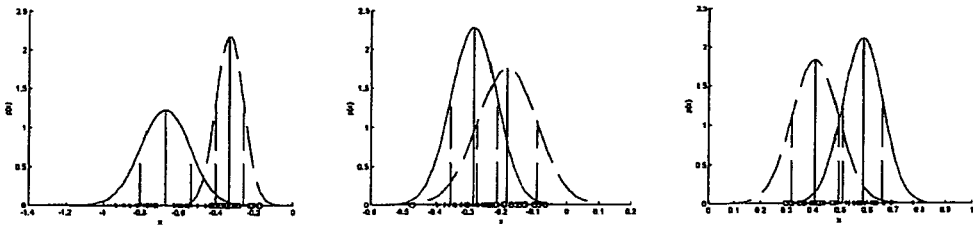
FIG. 9 shows the outcome of a statistical analysis on test data for three different variables.

The expected values $m_{fall}$ and $m_{no\ fall}$ and the covariance matrices $\Sigma_{fall}$ and $\Sigma_{no\ fall}$ were calculated using test data from 29 falls and 18 non-falls. FIG. 9 shows the results for Variable 1 (left), Variable 2 (center), and Variable 3 (right).

The expectation value m is calculated as:

$$m_i = E(x_i) = \frac{1}{n}\sum_{k=1}^{n} x_i(k) \quad [14]$$

and the covariance matrix Σ as:

$$\Sigma = \begin{bmatrix} \sigma_{11} & \sigma_{12} & \sigma_{13} \\ \sigma_{21} & \sigma_{22} & \sigma_{23} \\ \sigma_{31} & \sigma_{32} & \sigma_{33} \end{bmatrix}, \text{ where} \quad [15]$$

$$\sigma_{ij} = \frac{1}{n}\sum_{k=1}^{n}(x_i(k) - m_i)(x_j(k) - m_j)$$

Given the values for m and Σ, it is possible to decide whether a fall has occurred or not. Assume data x from a possible fall. Equation 13 then returns two values $f_{fall}(x)$ and $f_{no\ fall}(x)$ for a fall and a non-fall, respectively. It may be easier to relate to the probability for a fall than for a non-fall.

When calculating the probability for a fall, the probability for a person ending up on the floor after a non-fall, p(not fall|on floor), and after a fall, p(fall|on floor), must be taken into account in order to be statistically correct. However, the current model assumes that these two are equal.

$$p_{fall}(x) = \frac{p(\text{fall}|\text{ on floor}) \cdot f_{fall}(x)}{p(\text{fall}|\text{ on floor}) \cdot f_{fall}(x) + p(\text{not fall}|\text{ on floor}) \cdot f_{nofall}(x)} \quad [16]$$

$$= \{p(\text{not fall}|\text{ on floor}) = p(\text{fall}|\text{ on floor})\}$$

$$= \frac{f_{fall}(x)}{f_{fall}(x) + f_{nofall}(x)}$$

This implies that if $f_{fall}(x)$ is higher than $f_{no\ fall}(x)$ then the decision is that a fall has occurred, and vice versa if $f_{fall}(x)$ is lower than $f_{no\ fall}(x)$.

Figure 10:
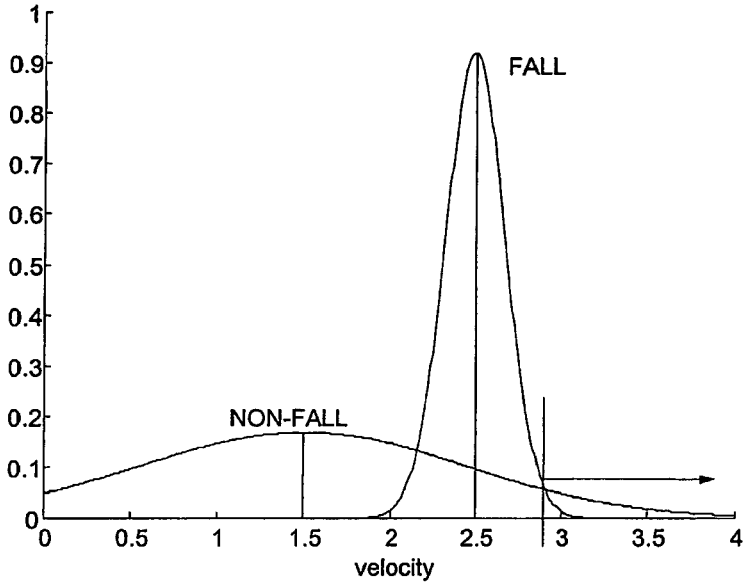
FIG. 10 is a diagram of a theoretical distribution of probabilities for fall and non-fall.
Figure 11:
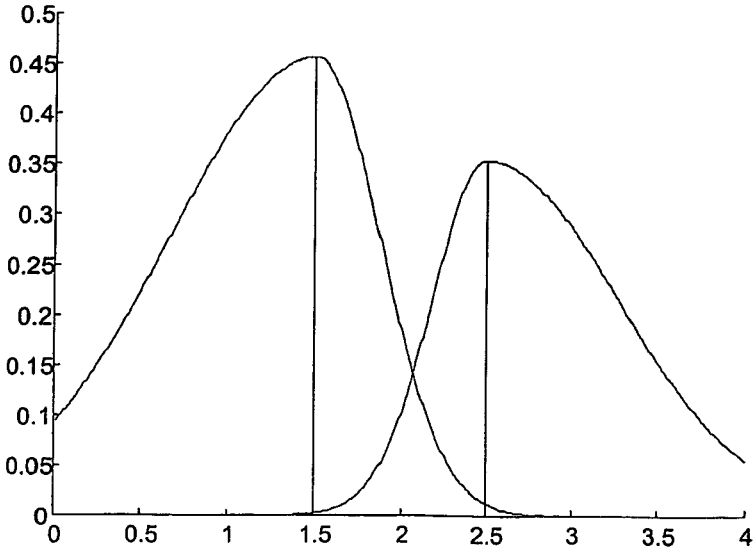
FIG. 11 is a diagram of a practical distribution of probabilities for fall and non-fall.

Assume two one-dimensional normal distributed variables, one with high variance and the other with low variance. The normal distribution functions for these variables could then look like in FIG. 10. if the high variance variable represents the velocities for a non-fall, and the low variance variable the velocities for a fall, then a high velocity could result in a higher $f_{no\ fall}(x)$ value than the $f_{fall}(x)$ value (area marked with arrow in FIG. 10). This would imply a higher probability for a non-fall. This is of course incorrect, since common sense tells that the higher velocity the higher probability for a fall. Thus, the normal distribution is not an optimum model of the distribution for the variables. It would rather look like in FIG. 10.

Figure 12:
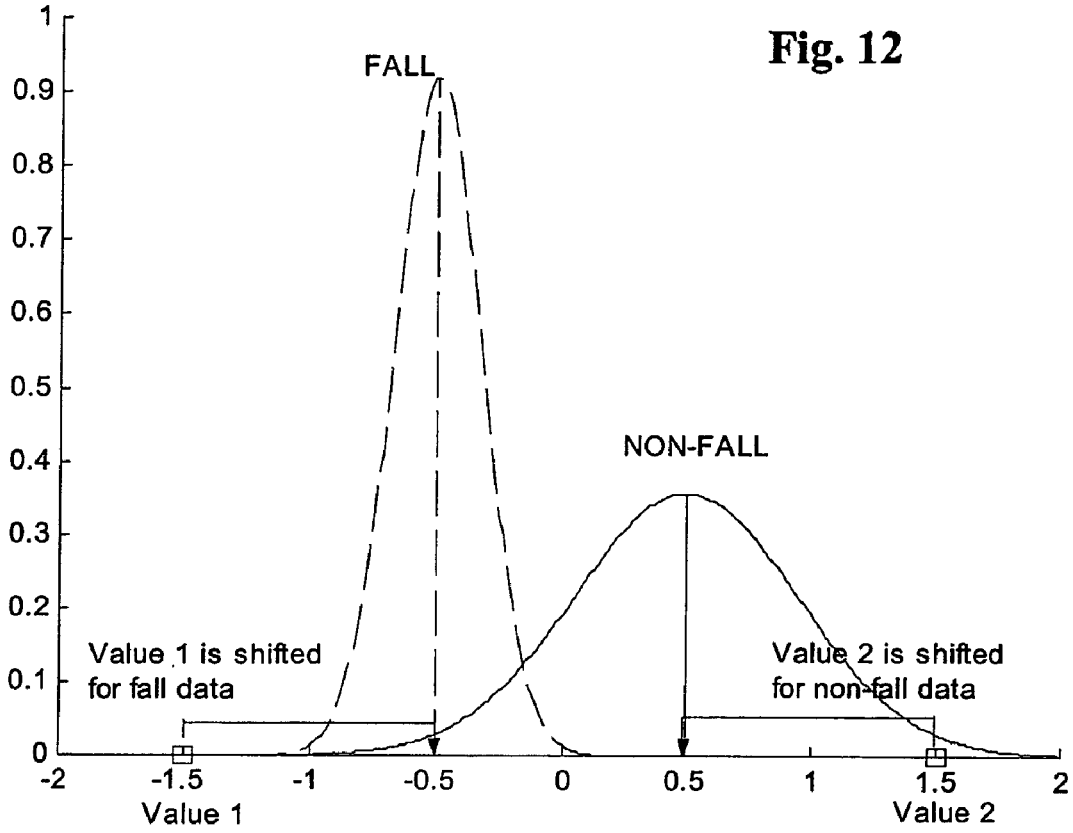
FIG. 12 is a diagram showing principles for shifting inaccurate values.

Luckily the variances do not differ that much between the fall and non-fall cases, see FIG. 9. To compensate for the occurring inaccuracies, the x values are shifted to m if inaccurate, i.e. if calculating the $f_{fall}(x)$ value and x is higher than $m_{fall}$ then x is shifted to $m_{fall}$ and respectively if calculating the $f_{no\ fall}(x)$ and x is lower than $m_{no\ fall}$ then x is shifted to $m_{no\ fall}$, see FIG. 12.

Figure 13:
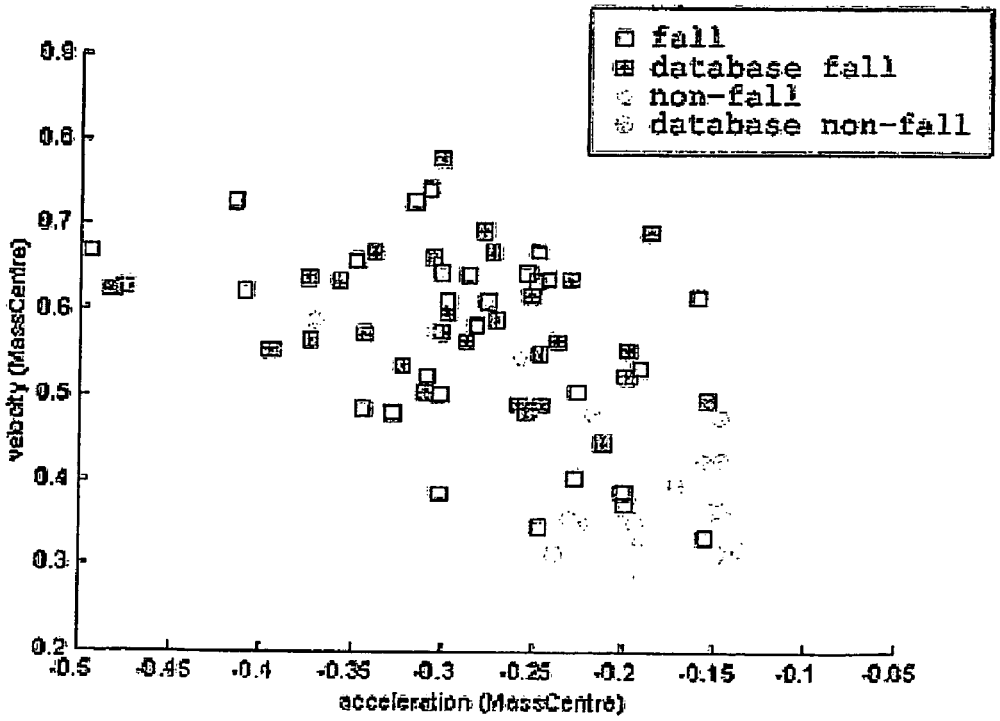
FIG. 13 is a plot of velocity versus acceleration for a falling object, calculated based on a MassCentre algorithm.
Figure 14:
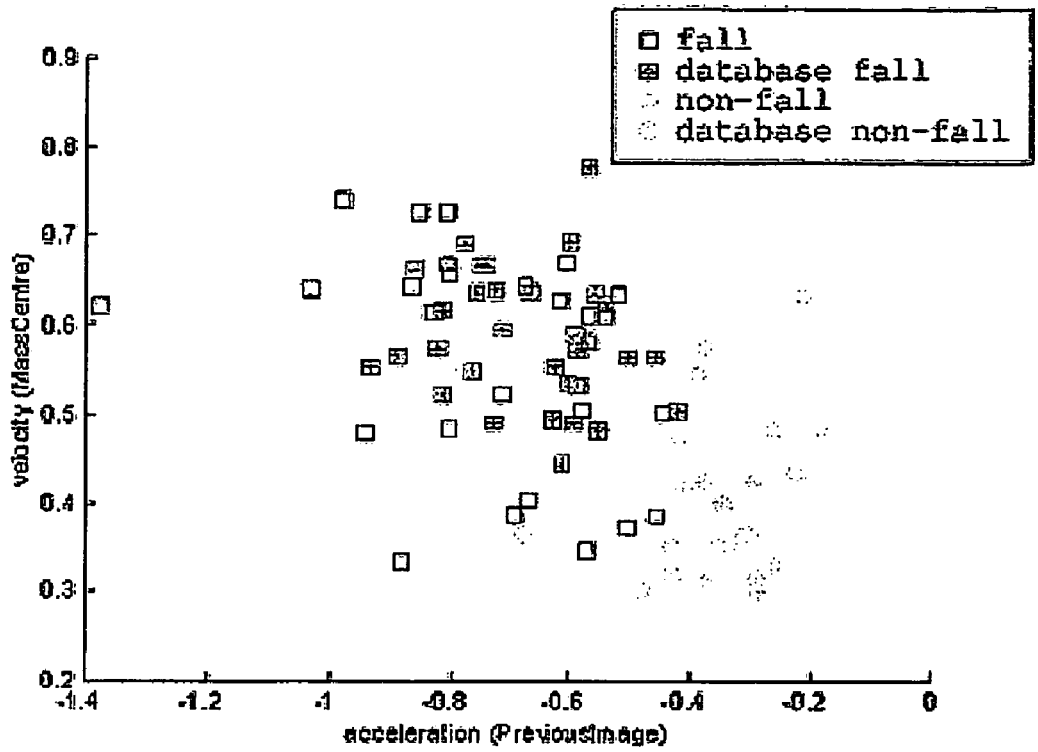
FIG. 14 is a plot of velocity versus acceleration for a falling object, based on a PreviousImage algorithm.
Figure 15:
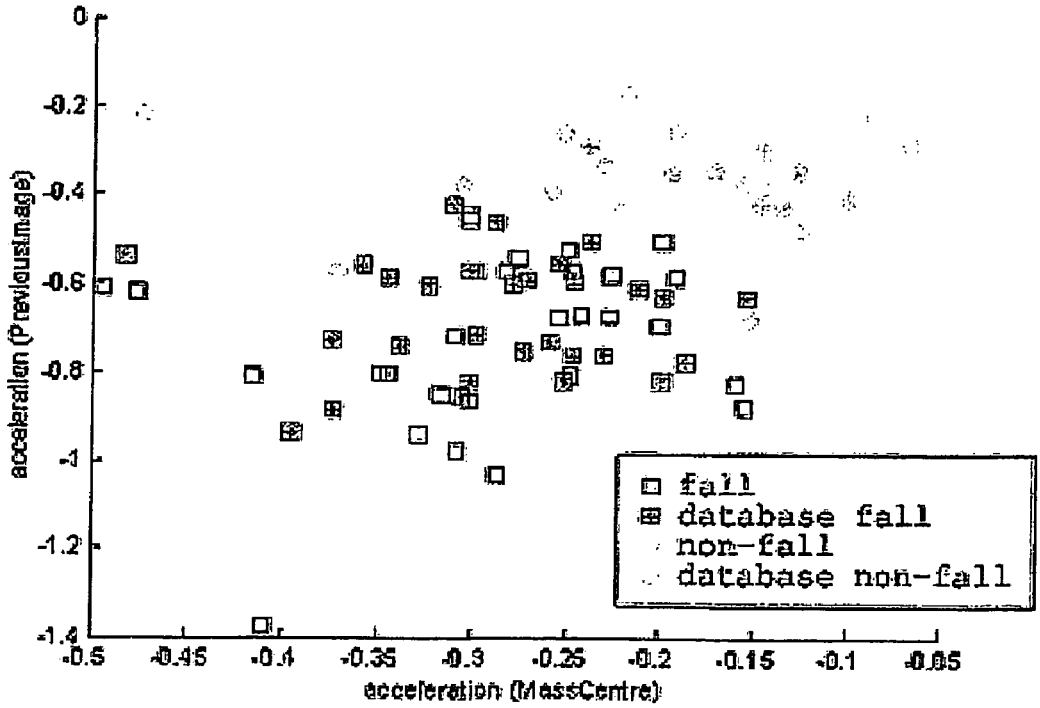
FIG. 15 is a plot of acceleration for a falling object, calculated based on the PreviousImage algorithm versus acceleration for a falling object, calculated based on the MassCentre algorithm.

The tests were conducted on an embodiment developed in MATLAB™, for 58 falls and 24 non-falls. The algorithms returned the values shown in FIGS. 13-15.

The falls and no-falls used as input for the database were tested in order to decide whether the model worked or not. Out of the 29 falls, 28 were detected, and none of the 18 non-falls caused a false alarm. Thus, the model worked properly.

Among the other test data, 27 falls were detected out of 29 possible, and 2 of 6 non-falls returned a false alarm.

Hereinabove, several embodiments of the invention have been described with reference to the drawings. However, the different features or algorithms may be combined differently than described, still within the scope of the present invention.

For example, the different algorithms may run all in parallel, and the algorithms may be combined as defined above and in the claims at suitable time occasions. Specifically, the Fall algorithms may run all the time but only be used when the Floor algorithms indicate that a person is lying on the floor.

The invention is only limited by the appended patent claims.

Appendix A

Basic Image Analysis

Image analysis is a wide field with numerous embodiments, from face recognition to image compression. This chapter will explain some basic image analysis features.

A.1. A Digital Image

A digital image is often represented as an m by n matrix, where m is the number of rows and n the number of columns. Each matrix element (u,v), where u=1 . . . m and v=1 . . . n, is called a pixel. The more pixels in a digital image the higher resolution.

Each pixel has a value, depending on which kind of image it is. If the image is a grey scale image with 256 grey scale levels every pixel has a value between 0 and 255, where 0 represent black and 255 white. However, if the image is a colour image one value isn't enough. In the RGB-model every pixel has three values between 0 and 255, if 256 levels are assumed. The first value is the amount of red, the second the amount of green and the last the amount of blue. In this way over 16 millions (256*256*256) different colour combinations can be achieved, which is enough for most embodiments.

A.2. Basic Operations

Since the digital image is represented as a matrix, standard matrix operations like addition, subtraction, multiplication and division can be used. Two different multiplications are available, common matrix multiplication and element wise multiplication:

$$A = B \cdot C \leftrightarrow A(u, v) = \sum_{i=1}^{n} B(u, i) \cdot C(i, v), \text{ for} \quad [1.]$$

$$u = 1 \ldots m \text{ and } v = 1 \ldots n \text{ and}$$

$$A = B \cdot C \leftrightarrow A(u, v) = B(u, v) \cdot C(u, v), \text{ for} \quad [2.]$$

$$u = 1 \ldots m \text{ and } v = 1 \ldots n$$

respectively.

A.3. Convolution and Correlation

Another operation that is useful is the convolution or correlation between two images. Often one of the images, the kernel, is small, e.g. a 3×3 matrix. The correlation between the images B and C is defined as:

$$A = B \circ C \leftrightarrow A(u, v) = \sum_{i=1}^{m_C} \sum_{j=1}^{n_C} B\left(u - \frac{m_c}{2} + i, v - \frac{n_C}{2} + j\right) \cdot C(i, j), \quad [3.]$$

$$\text{for } u = 1 \ldots m \text{ and } v = 1 \ldots n$$

The convolution is defined as:

$$A = B * C \leftrightarrow A(u, v) = \sum_{i=1}^{m_C} \sum_{j=1}^{n_C} B\left(u + \frac{m_c}{2} - i, v + \frac{n_C}{2} - j\right) \cdot C(i, j), \quad [4.]$$

$$\text{for } u = 1 \ldots m \text{ and } v = 1 \ldots n$$

Correlation can be used to blur an image, $$C = \frac{1}{9}\begin{bmatrix} 1 & 1 & 1 \\ 1 & 1 & 1 \\ 1 & 1 & 1 \end{bmatrix}$$

to find edges in the image, $$C = \begin{bmatrix} 1 & 0 & -1 \\ 1 & 0 & -1 \\ 1 & 0 & -1 \end{bmatrix} \text{ or } C = \begin{bmatrix} 1 & 1 & 1 \\ 0 & 0 & 0 \\ -1 & -1 & -1 \end{bmatrix}$$

or to find details, area with high variance, in an image, $$C = \begin{bmatrix} 1 & 1 & 1 \\ 1 & -8 & 1 \\ 1 & 1 & 1 \end{bmatrix}$$

A.4. Morphology

Morphing is a powerful processing tool based on mathematical set theory. With the help of a small kernel B a segment A can either be expanded or shrunk. The expansion process is called dilation and the shrinking process is called erosion. Mathematically these are described as:

$$A \oplus B = \{x \mid [(\hat{B})_x \cap A] \subseteq A\} \quad [5.]$$

and $$A \Theta B = \{x \mid (B)_x \subseteq A\} \quad [6.]$$

respectively, where $$(A)_x \{c \mid c = a + x, \text{ for } a \in A\} \quad [7.]$$

$$\hat{B} = \{x \mid x = -b, \text{ for } b \in B\} \quad [8.]$$

The erosion of A with B followed by the dilation of the result with B is called opening. This operation separates segments from each other.

$$A \circ B = (A \Theta B) \oplus B \quad [9.]$$

Another operation is closing. It's a dilation of A with B followed by an erosion of the result with B. Closing an image will merge segments and fill holes.

$$A \bullet B = (A \oplus B) \Theta B \quad [10.]$$

A.5. Segmentation

It is often useful to subdivide the image into different segments, depending on e.g. shape, colour, variance and size. Segmentation can be done on colour images, grey level images and binary images. Only binary image segmentation is explained here.

One way to segment a binary image is by using the region-grow algorithm:

```
segmentImage(Image *image) {
    for each pixel in image {
        create new segment;
        regionGrowSegment(pixel, segment);
    }
}
regionGrowSegment(Pixel *pixel, Segment *segment) {
    add pixel to segment;
    set pixel as visited;
    for each neighbour to the pixel {
        if neighbour is 1 and hasn't been visited {
            regionGrowSegment(neighbour, segment);
        }
    }
}
```

As seen above the region-grow algorithm is recursive and therefore uses a lot of memory. In systems with low memory, this could cause memory overflow. Because of this the following iterative method has been developed.

```
for every pixel in the image {
    find a pixel equal to 1 and denote this start pixel {
        do until back to start pixel {
            step to the next pixel at the rim;
        }
        if visited pixels are next to prior found pixels {
            add visited pixels to the prior class;
        } else {
            create a new class;
        }
            subtract the visited pixels from the image;
    }
}
```

The invention claimed is:

1. A method of monitoring an object with respect to a potential fall condition, comprising:

observing a detection area with an optical detector;

determining, based on at least one image of the detection area, that the object is in an upright condition in the detection area; by determining an angle between the object and a vertical direction and that the angle is below 20 degrees; by transforming foot image coordinates (uf, vf) of a foot portion of the object into foot room coordinates ($X_f$, $Y_f$=0, $Z_f$);

adding a length ΔY to a vertical coordinate of the foot room coordinates;

transforming at least the vertical coordinate to form top image coordinates (uh, Vh), whereby the vertical direction is given by a vector, between the foot image coordinates (uf, Vt) and the top image coordinates (uh, vh); and determining an angle between said vector and the object;

waiting for a predetermined time period; and emitting an alarm after said predetermined time period.

2. The method of claim 1, wherein the angle is below 10 degrees.

3. The method of claim 1, further comprising: determining a direction of the object by calculating mass centres of at least two extreme parts of the object and determining a vector between them as the direction of the object.

4. The method of claim 1, further comprising: determining mass centres of at least two extreme parts of the object; and determining a length of the object; wherein said step of determining that the object is in an upright condition comprises determining that the length of the object is above a predetermined length.

5. The method of claim 4, wherein said predetermined length represents an object length of at least 2 meters.

6. The method of claim 4, further comprising: transforming said mass centres into room coordinates at a floor level (Y=0) in the detection area; and determining the length of the object in said room coordinates.

7. The method of claim 1, further comprising calculating the surface area of the object; wherein said step of determining that the object is in an upright condition comprises determining that the surface area exceeds a predetermined minimum value.

8. The method of claim 1, wherein a state for checking for an upright condition is initiated upon the identification of a movement in at least part of a bed in the detection area.

9. The method of monitoring an object with respect to a potential fall condition, comprising:

observing a detection area with an optical detector;

defining a room height limit in room coordinates;

transforming said room height limit into an image height limit in image coordinates;

forming a foreground image by calculating a difference between a current image and a background image;

deriving a number of foreground elements from the foreground image, said number representing the foreground elements that are located below the image height limit in the foreground image;

determining based on at least one image of the detection area, that the object is in an upright condition in the detection area; by determining that said number exceeds a predetermined value, waiting for a predetermined time period; and emitting an alarm after said predetermined time period.

10. A device for monitoring an object with regard to a potential fall condition, comprising:

a detector for observing a detection area;

a determination device for determining, based on at least one image from the detector, that the object is in an upright condition in the detection area; comprising a height limit calculation device for defining a room height limit in room coordinates; transforming said room height limit into an image height limit in image coordinates; forming a foreground image by calculating a difference between a current image and a background image; deriving a number of foreground elements from the foreground image, said number representing the foreground elements that are located below the image height limit in the foreground image; wherein determining that the object is in the upright condition comprises determining that said number exceeds a predetermined value, and an alarm device for emitting an alarm a predetermined time period after a determination of an upright condition by the determination device.

11. The device of claim 10, wherein said determination device further comprises an angle calculation device for calculating an angle between the object and a vertical direction, wherein determining that the object is in an upright condition comprises determining that the angle is below 20 degrees, preferably below 10 degrees.

12. The device of claim 10, wherein said determination device further comprises a length calculation device for determining mass centres of at least two extreme parts of the object; and calculating a length of the object; wherein determining that the object is in an upright condition comprises determining that the length of the object is above a predetermined length.

13. The device of claim 10, wherein said determination device further comprises an area calculation device for calculating the surface area of the object; wherein determining that the object is in an upright condition comprises determining that the surface area exceeds a predetermined minimum value.

14. The device of claim 10, further comprising of a movement detector for identifying movement in at least part of a bed in the detection area, wherein said determination device is initiated to check for an upright condition upon the identification of a movement by the movement detector.

15. A method of monitoring an object with regard to a fall condition, comprising:

observing a detection area with an optical detector;

determining, based on at least one image of the detection area, that the object is lying on a floor in the detection area; by calculating a foreground image, which is the difference between a current image and a predetermined background image, calculating the ratio of the foreground image that is present on the floor of the detection area, and determining that the ratio exceeds a predetermined threshold ratio;

waiting for a predetermined time period; and emitting an alarm after said predetermined time period.

16. The method of claim 15, wherein said time period is more than 2 minutes.

17. The method of claim 15, wherein said threshold ratio is at least 0.5.

18. The method of claim 15, further comprising: determining an angle between the object and a vertical direction, wherein the step of determining that the object is lying on a floor comprises determining that the angle is above 10 degrees, preferably above 20 degrees.

19. The method of claim 18, wherein said step of determining an angle comprises: transforming foot image coordinates ($u_f$, $v_f$) of a foot portion of the object into foot room coordinates ($X_f$, $Y_f$=0, $Z_f$); adding a length ΔY to a vertical coordinate of the foot room coordinates; transforming at least the vertical coordinate to form top image coordinates($u_h$,$v_h$), whereby the vertical direction is given by a vector between the foot image coordinates($u_f$, $v_f$) and the top image coordinates($u_h$,$v_h$) ; and determining an angle between said vector and the object.

20. The method of claim 19, further comprising: determining a direction of the object by calculating mass centres of at least two extreme parts of the object and determining a vector between them as the direction of the object.

21. The method of claim 16, wherein the time period is between 5 and 15 minutes.

22. The method of claim 16, wherein the time period is about 10 minutes.

23. A method of monitoring an object with regard a fall condition, comprising observing a detection area with an optical detector;

determining, based on at least one image of the detection area, that the object is lying on a floor in the detection area; by deriving an image sequence for at least a time period preceding the determination that the object is lying on the floor; and analysing the derived image sequence for high velocities and/or negative accelerations;

wherein a subsequent step for identifying the fall condition comprises determining that the velocity is above a predetermined value and/or the acceleration is below a negative value; and emitting an alarm after a predetermined time period.

24. The method of claim 23, wherein said time period includes a time before and a time after said determination.

25. The method of claim 23, wherein said time period is 2 seconds.

26. The method of claim 23, further comprising: pre-calculating a probability curve for the fall condition and a probability curve for a non-fall condition for velocity and/or negative acceleration, wherein the subsequent step for identifying the fall condition comprises determining that the velocity and/or the acceleration has the highest probability for the fall condition.

27. The method of claim 23, wherein the identification of the fall condition is initiated upon the determination that the object is lying on the floor.

28. A method of monitoring an object with regard a fall condition, comprising observing a detection area with an optical detector;

determining, based on at least one image of the detection area, that the object is lying on a floor in the detection area; by forming a foreground image by calculating a difference between a current image and a previous image; and deriving a number of foreground elements from the foreground image; wherein a subsequent step for identifying the fall condition comprises determining that the number of foreground elements exceeds a foreground number value; and emitting an alarm after a predetermined time period.

29. The method of claim 28, wherein the foreground number value represents the number of foreground elements in a reference foreground image which is derived by calculating a difference between a current image and a background image.

30. The method of claim 28, further comprising: defining a room height limit in room coordinates; transforming said room height limit into an image height limit in image coordinates; wherein said number of foreground elements represents the foreground elements that are located below the image height limit in the foreground image.

31. The method of claim 28, wherein said current image is set as a background image if there is no change in the foreground image during a predetermined time period.

32. A device for monitoring an object with regard to a fall condition, comprising:

a detector for observing a detection area;

a determination device for determining, based on at least one image from the detector, that the object is lying on a floor in the detection area; said determination device further comprises a foreground calculation device for calculating a foreground image, which is the difference between a current image and a predetermined background image; and calculating the ratio of the foreground image that is present on the floor of the detection area and the total foreground image; wherein determining that the object is lying on the floor comprises determining that the ratio exceeds a predetermined threshold ratio, and an alarm device for emitting an alarm a predetermined time period after a determination that the object is lying on the floor by the determination device.

33. The device of claim 32, wherein said threshold ratio is at least 0.5.

34. The device of claim 32, wherein said determination device further comprises an angle calculation device for calculating an angle between the object and a vertical direction, wherein determining that the object is lying on a floor comprises determining that the angle is above 10 degrees, preferably above 20 degrees.

35. The device of claim 32, wherein said determination device further comprises a length calculation device for determining mass centres of at least two extreme parts of the object; and calculating a length of the object; wherein determining that the object is lying on a floor comprises determining that the length of the object is below a predetermined length.

36. The device of claim 32, further comprising of a fall detector for identifying the fall in the detection area, wherein said fall detector is initiated to identify a fall upon said determination device determining that the object is lying on the floor.

37. The device of claims 36, wherein said fall detector comprises: means for deriving an image sequence for at least a time period preceding the determination, by the determination device, that the object is lying on the floor; means for analysing the derived image sequence for high velocities and/or negative accelerations; and means for identifying the fall condition by determining that the velocity is above a predetermined value and/or the acceleration is below a negative value.

38. The device of claim 36, wherein said fall detector comprises; means for forming the foreground image by calculating a difference between the current image and a previous image; means for deriving a number of foreground elements from the foreground image; and means for identifying the fall condition by determining that the number of foreground elements exceeds a foreground number value.

* * * * *